US011312000B2

(12) United States Patent
Sun

(10) Patent No.: US 11,312,000 B2
(45) Date of Patent: Apr. 26, 2022

(54) WORKBENCH

(71) Applicant: SHANGHAI EASY-USE TOOLS ENTERPRISE CO. LTD., Shanghai (CN)

(72) Inventor: Shiyu Sun, Shanghai (CN)

(73) Assignee: SHANGHAI EASY-USE TOOLS ENTERPRISE CO. LTD., Shanghai (CN)

( * ) Notice: Subject to any disclaimer, the term of this patent is extended or adjusted under 35 U.S.C. 154(b) by 449 days.

(21) Appl. No.: 16/340,561

(22) PCT Filed: Aug. 1, 2018

(86) PCT No.: PCT/CN2018/097970
§ 371 (c)(1),
(2) Date: Apr. 9, 2019

(87) PCT Pub. No.: WO2019/024864
PCT Pub. Date: Feb. 7, 2019

(65) Prior Publication Data

US 2019/0314975 A1 Oct. 17, 2019

(30) Foreign Application Priority Data

Aug. 4, 2017 (CN) ..... 201710660300.6

(51) Int. Cl.
*B25H 1/04* (2006.01)
*A47B 3/02* (2006.01)
(Continued)

(52) U.S. Cl.
CPC ..... *B25H 1/04* (2013.01); *A47B 3/02* (2013.01); *A47B 3/0818* (2013.01); *A47B 13/081* (2013.01)

(58) Field of Classification Search
CPC ..... B25H 1/04; A47B 3/02; A47B 3/0818; A47B 13/081
See application file for complete search history.

(56) References Cited

U.S. PATENT DOCUMENTS 4,155,386 A * 5/1979 Alessio ..... B25H 1/04 108/123
4,252,304 A * 2/1981 Pettican ..... B25B 1/02 269/139

(Continued)

FOREIGN PATENT DOCUMENTS

CN 201505900 U 6/2010
CN 103990971 A 8/2014

(Continued)

OTHER PUBLICATIONS

English translation of Fr2804358 from espacenet (Year: 2021).*
English translation of FR2793394 from espacenet (Year: 2021).*

*Primary Examiner* — Daniel J Rohrhoff
(74) *Attorney, Agent, or Firm* — Muncy, Geissler, Olds & Lowe, PC

(57) ABSTRACT

The invention discloses a workbench, comprising: a folding base comprising a left support frame and a right support frame cross connected with each other by a pivot and a handle rod connected with tops of the left support frame and the right support frame; a movable plate fixed on the left support frame and provided with at least one first fixing hole; a fixed plate fixed on the right support frame and provided with at least one second fixing hole; the movable plate and the fixed plate are spread out on the upper surface of the folding base as the left support frame and right support frame are unfolded; and the movable plate and the fixed plate are folded downwards along both sides of the handle rod as the left support frame and the right support frame are furled. The present invention allows the workbench to be (Continued)

folded by folding downwards the movable plate and the fixed plate, such that the workbench occupies less space and the folded workbench is more secure. The additional first fixing hole and second fixing hole on the workbench effectively stabilize workpieces.

9 Claims, 7 Drawing Sheets

(51) Int. Cl.
*A47B 3/08* (2006.01)
*A47B 13/08* (2006.01)

(56) References Cited

U.S. PATENT DOCUMENTS 4,378,107 A 3/1983 Wagster et al.
4,909,491 A * 3/1990 Cheng ..... B23D 47/025 269/139
5,584,254 A * 12/1996 Williams ..... A47B 3/02 108/118
5,681,034 A * 10/1997 Noniewicz ..... B25H 1/04 269/139
7,090,210 B2 * 8/2006 Lawrence ..... B25H 1/04 269/139
9,278,446 B2 * 3/2016 Lifshitz ..... B25H 1/02
2007/0018371 A1 * 1/2007 Campbell ..... B25B 1/125 269/139
2020/0391372 A1 * 12/2020 Strempke ..... B25H 1/06

FOREIGN PATENT DOCUMENTS

CN 205238204 U 5/2016
CN 207290020 U 5/2018
FR 2793394 A1 * 11/2000 ..... A47B 3/02
FR 2804358 A1 * 8/2001 ..... B25H 1/14

* cited by examiner

WORKBENCH

FIELD OF THE INVENTION

This invention relates to the field of wood processing, and more particularly, to a workbench suitable for wood board processing.

DESCRIPTION OF THE RELATED ART

The existing wood processing workbench is large in size and cannot be folded, occupies a large space and is inconvenient to carry. The wood board needs to be manually supported or fixed by the user during processing, which is inconvenient to use. What's more, the regular wood processing workbench is not provided with a storage rack to hold tools. There is no place to hold tools required during the wood processing, which is very troublesome.

SUMMARY OF THE INVENTION

Because of the problems in the prior art, the present invention provides a workbench capable of being folded down and convenient to carry with small size, and capable of effectively solving the problems in the prior art.

The invention discloses a workbench, comprising: a folding base comprising a left support frame and a right support frame cross connected with each other by a pivot and a handle rod connected with tops of the left support frame and the right support frame; a movable plate fixed on the left support frame and provided with at least one first fixing hole; a fixed plate fixed on the right support frame and provided with at least one second fixing hole; the movable plate and the fixed plate are spread out on the upper surface of the folding base as the left support frame and right support frame are unfolded; and the movable plate and the fixed plate are folded downwards along both sides of the handle rod as the left support frame and the right support frame are furled.

Preferably, t the left support frame comprises two parallel left support rods and two left fixed rods pivotally connected with tops of the two parallel left support rods respectively; the two left fixed rods are respectively capable of being rotatably folded relative to the left support rod, front ends of the two left fixed rods are respectively provided with a pitch adjusting mechanism, and the movable plate is fixed on the two pitch adjusting mechanisms and moves away from the fixed plate according to adjustment of the pitch adjusting mechanisms; and the right support frame comprises two parallel right support rods and two right fixed rods respectively pivotally connected with tops of the two parallel right support rods; the two right fixed rods are respectively capable of being rotatably folded relative to the right support rods, and the fixed plate is fixed on the right fixed rods.

Preferably, the pitch adjusting mechanism comprises screw rods connected with a handle and a quick pulling mechanism capable of controlling quick pushing and pulling of the screw rods, and the quick pulling mechanism comprises: a quick pulling plate with an inverted trapezoidal-shaped front end; a left push rod and a right push rod respectively connected to the left side and the right side of the quick pulling plate, wherein the quick pulling plate moves downwards to push the left push rod and the right push rod to move toward both sides; two screw rod fixing bases respectively fixed on one of the left fixed rods, wherein the screw rod fixing bases are provided with a radial perforation and the screw rods pass through therein; the screw rod fixing bases are further provided with a transverse perforation below the radial perforation, and the radial perforation and the transverse perforation are communicated with each other at a connection thereof; one side of the transverse perforation is locked by a fixed plate; a spring and a pressing block with an inner side face pressing against the spring are arranged in the transverse perforation, a thread matches the upper side face of the pressing block with the screw rods; and the outer side surface of the pressing block is abutted against the left push rod or the right push rod; when the quick pulling mechanism is at a locked position, the left push rod and the right push rod respectively abut the pressing block, and the pressing block is in contact with the screw rods arranged inside the radial perforation under the action of the spring, and the movable plate is only capable of moving relative to the fixed plate through manual rotation of the screw rods; and when the quick pulling plate is pulled down such that the quick pulling mechanism is at a unlocked position, the left push rod and the right push rod respectively move to both sides and push the pressing block to move toward outsides of the screw rod fixing bases, the upper surface of the pressing block does not contact the screw rods, and the screw rods are capable of being quickly pulled out or retracted.

Preferably, a foot is respectively arranged at bottom ends of the two left support rods and the right support rods, the foot comprises an elongated edge extending linearly along the outer edge of the left support rod or the right support rod, and an inclined straight edge forming an angle with the elongated edge; the elongated edge forms an apex angle with the inclined straight edge, and when the folding base is fully unfolded, the inclined straight edge flatly contacts the ground; and after the folding base is furled, the left support rod and the corresponding right support rod are securely in contact with the ground through the upper apex angle.

Preferably, the left support frame and/or the right support frame are provided with at least one storage rack, and the rack is provided with a plurality of storage holes with various hole patterns.

Preferably, a foot lever is provided at the bottom end of the left support frame and/or the right support frame.

Preferably, the left support frame and/or the right support frame are provided with at least one table fixture stand, and table fixtures arranged in the first fixing hole and the second fixing hole are fixed on the table fixture stand.

Preferably, the fixed plate comprises a first fixed plate and a second fixed plate, and the first fixed plate is integrally connected with the movable plate and provided with a ruler and/or a third fixing hole.

Preferably, the lower surface of the first fixed plate is provided with a lock hook or fixed column, and the lower surface of the second fixed plate is correspondingly provided with a fixed column or lock hook, and the first fixed plate and the second fixed plate are locked by toggling the lock hook to hook the fixed column.

Preferably, the fixed plate is provided with a locking mechanism for fixing the second fixed plate and the handle rod, and the locking mechanism comprises: a fixing base which is provided with a perforation and fixed on the lower surface of the second fixed plate by bolts; a left clamping rod and a right clamping rod which are oppositely arranged at in the perforation and between which a gripping space for gripping the handle rod is formed; an adjusting rod comprising a fixed end with an outward turning thread and a lifting rod connected to the fixed end, wherein diameter of the lower end of the pulling rod is larger than that of the upper end of the lifting rod, the lifting rod is arranged between the left clamping rod and the right clamping rod, when the adjusting rod is rotated to a unlocked position, the upper end of the lifting rod is located between the left clamping rod and the right clamping rod, and the left clamping rod and the right clamping rod are capable of rotating relative to each other; when the adjusting rod is rotated to a locked position, the lower end of the lifting rod is located between the left clamping rod and the right clamping rod, and the lower end of the lifting rod fixes the top ends of the left clamping rod and the right clamping rod, and the space between the left clamping rod and the right clamping rod is fixed; and an adjusting knob arranged at the adjusting rod and located on the upper surface of the second fixed plate; wherein the adjusting knob drives the fixed end of the adjusting rod to rotate to adjust the space between the left clamping rod and the right clamping rod.

The workbench disclosed by the present invention is mainly used for wood board processing. The workbench is capable of being folded by folding downwards the movable plate and the fixed plate, and is featured with simple structure, small spaces and convenience to carry. The folded workbench is more secure than the workbench in the prior art. The first fixing hole and the second fixing hole added to the workbench are capable of effectively fixing the position of the processed object, which is convenient for operation.

DESCRIPTION OF THE PREFERRED EMBODIMENTS

The present invention will be described in detail below in combination with specific embodiments.

Figure 1:
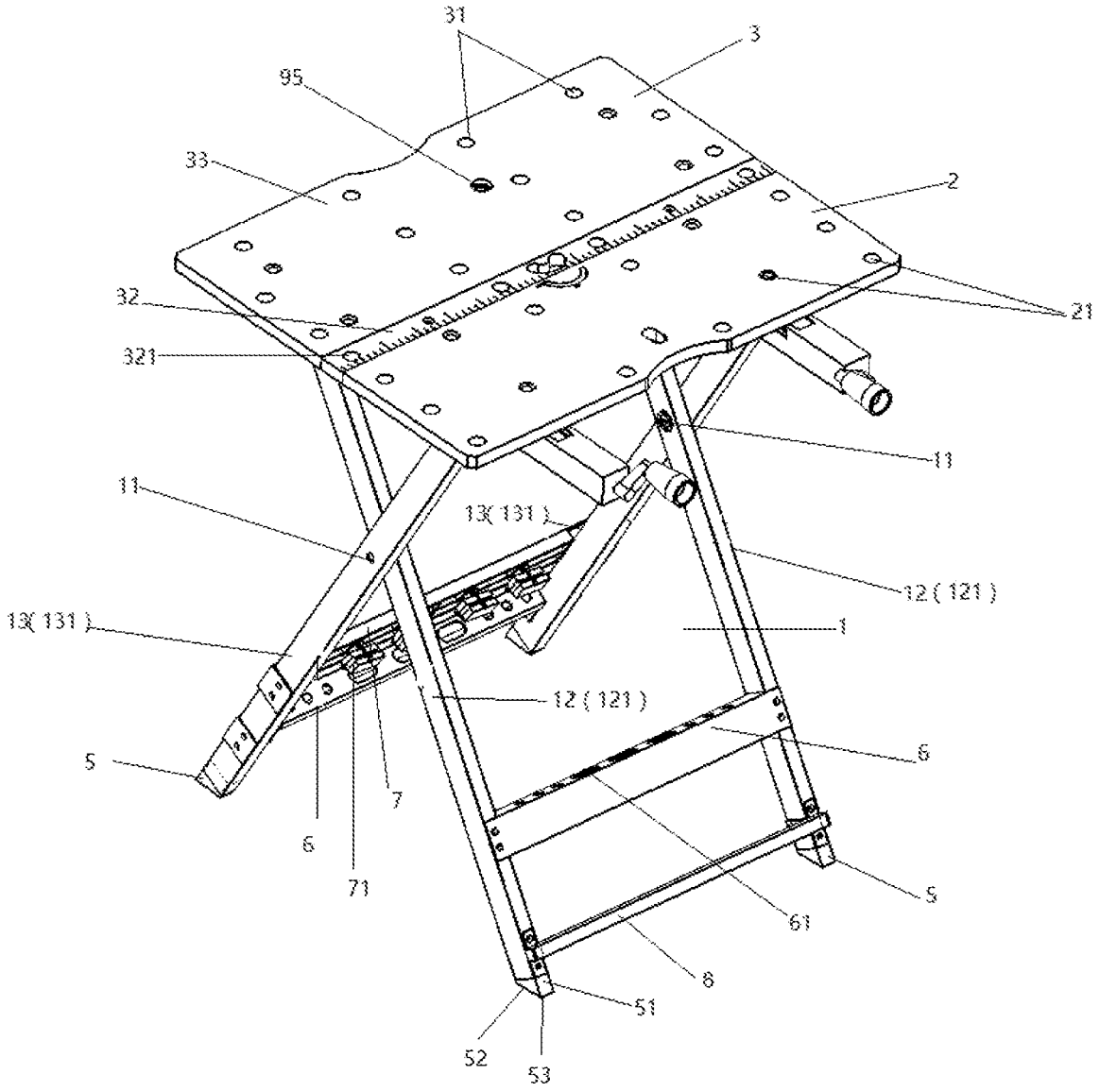
FIG. 1 is a structural diagram I for an unfolded embodiment of the present application.
Figure 2:
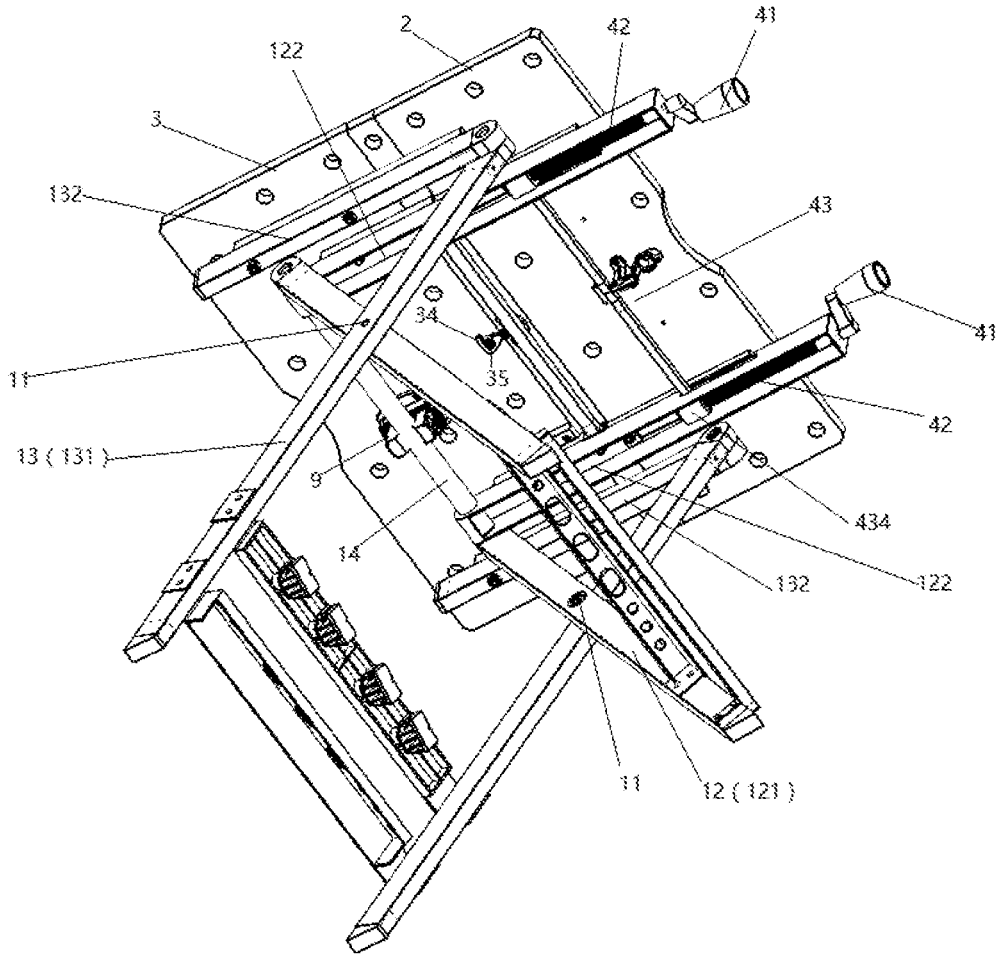
FIG. 2 is a structural diagram II for an unfolded embodiment of the present application.
Figure 3:
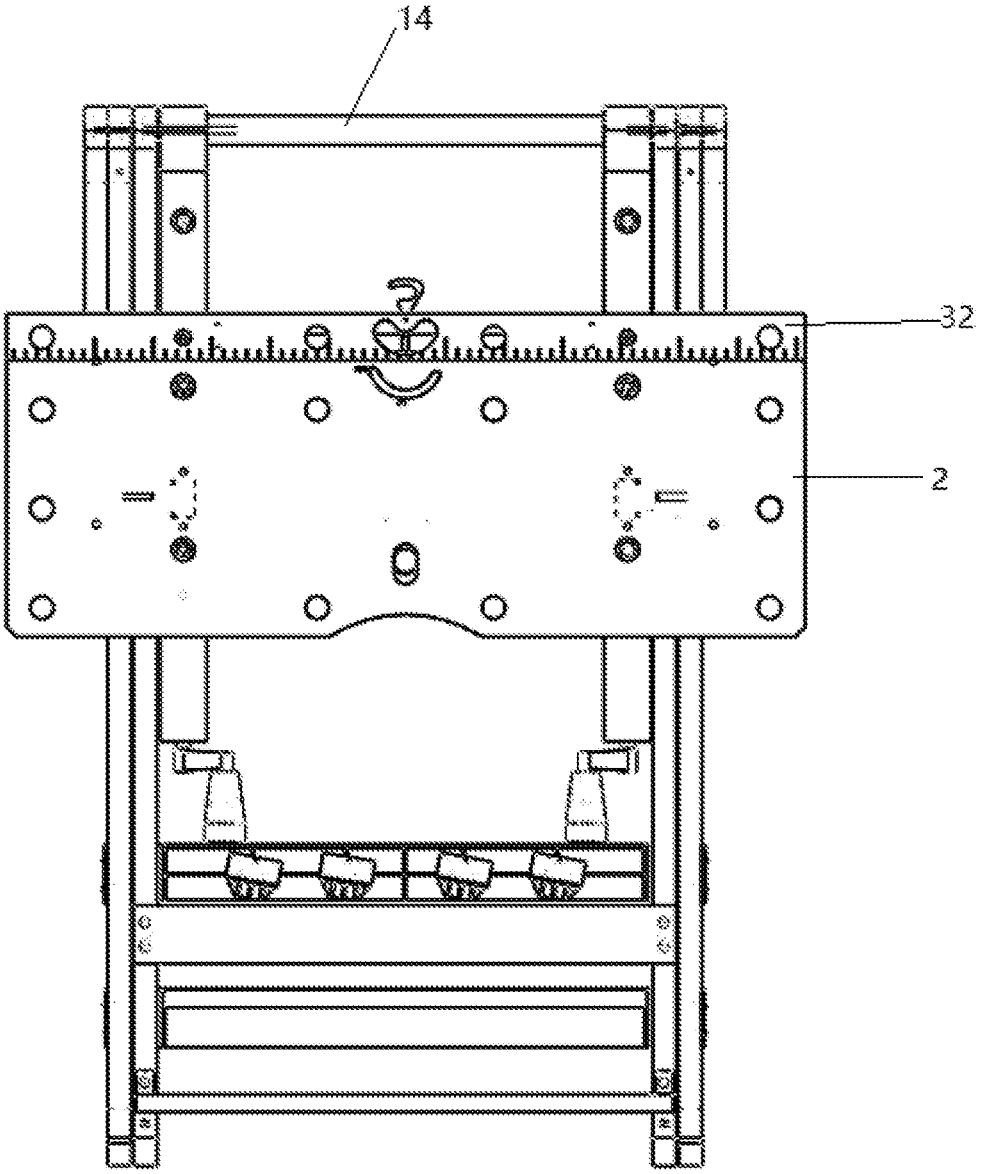
FIG. 3 is a schematic diagram showing the embodiment of the present application in the folded and furled state.

FIG. 1 and FIG. 2 are respectively the schematic diagram showing an embodiment of the workbench of the present application in the unfolded state. As shown in the figures, the workbench comprises a folding base 1, a movable plate 2 and a fixed plate 3.

The folding base 1 comprises a left support frame 12 and a right support frame 13 cross connected with each other by a pivot 11 and a handle rod 14 connected with tops of the left support frame and the right support frame (as shown in FIG. 2). The movable plate 2 is fixed on the left support frame 12 and provided with at least one first fixing hole 21. The fixed plate 3 is fixed on the right support frame 13 and provided with at least one second fixing hole 31. The movable plate 2 and the fixed plate 3 are spread out on the upper surface of the folding base 1 as the left support frame 12 and the right support frame 13 are unfolded. The movable plate 2 and the fixed plate 3 are folded downwards along both sides of the handle rod as the left support frame 11 and the right support frame 12 are furled, as shown in FIG. 2. The workbench is capable of being folded and unfolded, which is convenient to use and occupies less place in storage.

Figure 4:
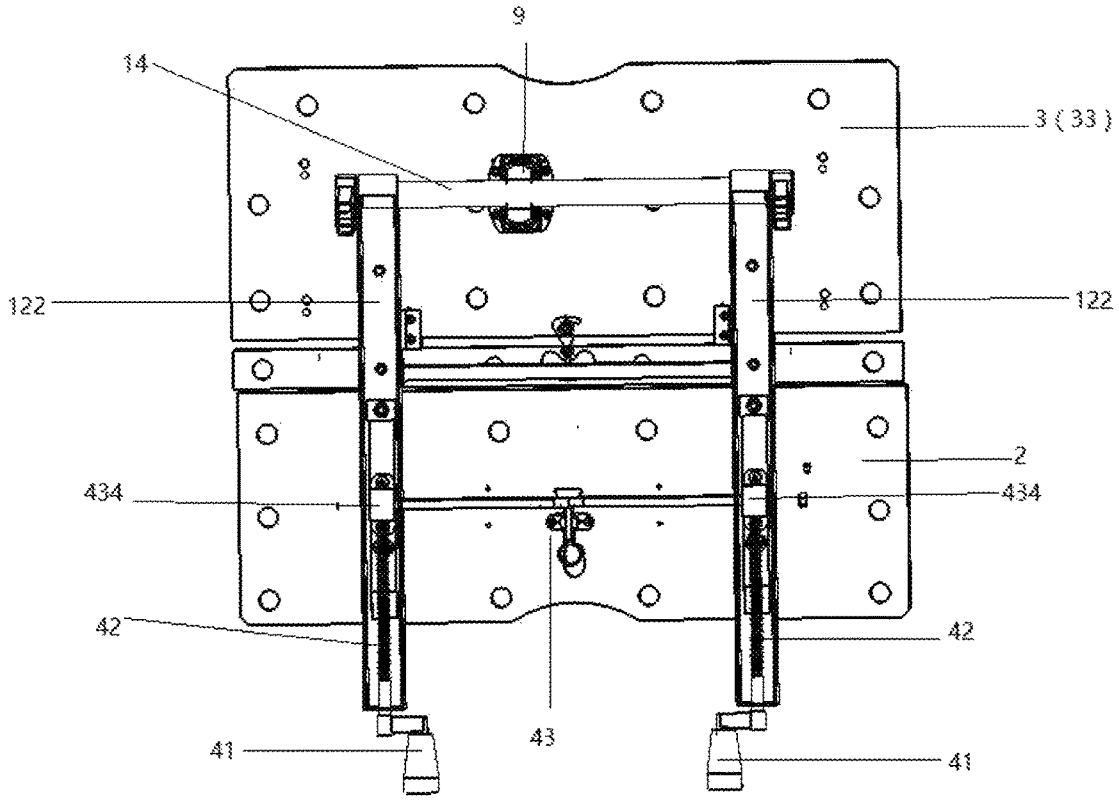
FIG. 4 is a back view showing the movable plate and the fixed plate of the present application in the unfolded state.

The folding base 1 comprises a left support frame 12 and a right support frame 13 cross connected with each other by a pivot 11 and a handle rod 14 connected with tops of the left support frame and the right support frame (as shown in FIG. 2). As shown in FIG. 4, the left support frame 12 comprises two parallel left support rods 121 and two left fixed rods 122 pivotally connected with tops of the two parallel left support rods respectively. The two left fixed rods 122 are respectively capable of being rotatably folded relative to the left support rod 121. Front ends of the two left fixed rods 122 are respectively provided with a pitch adjusting mechanism. The movable plate 2 is fixed on the two pitch adjusting mechanisms and moves away from the fixed plate 3 according to adjustment of the pitch adjusting mechanisms.

Figure 5:
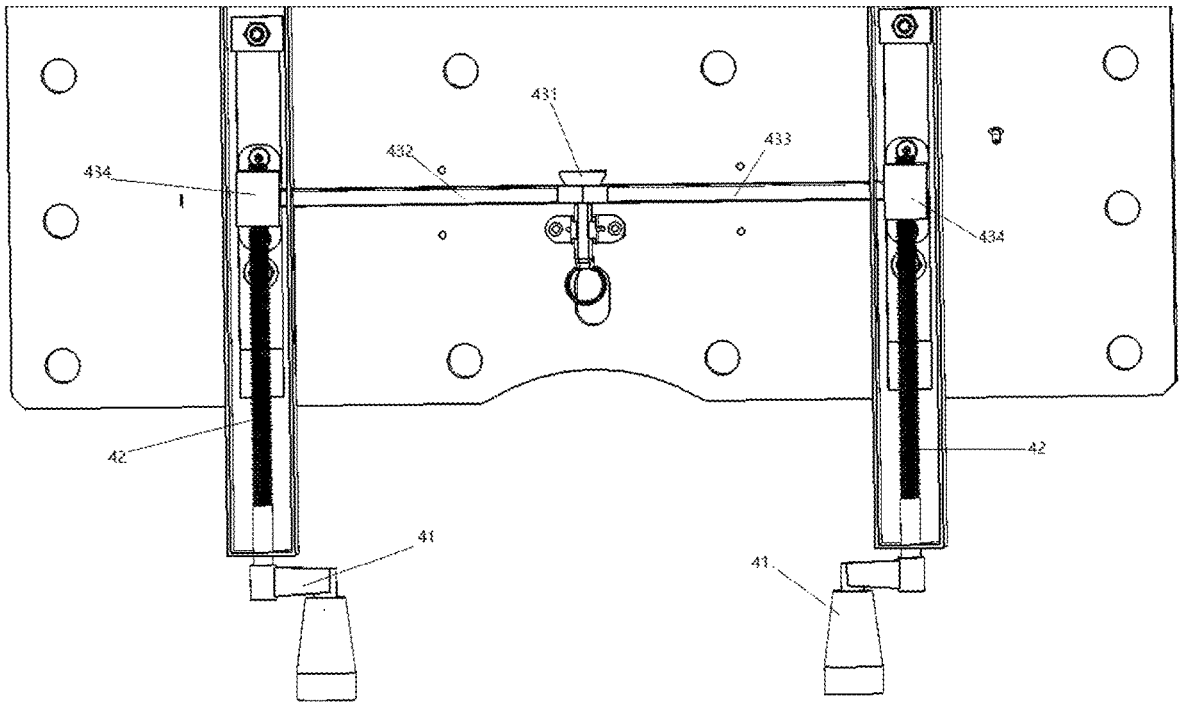
FIG. 5 is a local enlarged view of FIG. 4.

The structure of the pitch adjusting mechanism is detailed below. Please refer to FIG. 4 to FIG. 6. The pitch adjusting mechanism comprises two screw rods 42 connected with a handle 41 and a quick pulling mechanism 43 capable of controlling quick pushing and pulling of the screw rods 42. In the present embodiment, the quick pulling mechanism 43 is arranged between the two screw rods 42. The integration of the screw rods and the handle 41 allows adjustment of the distance of the movable plate 2 by manual control, and the quick pulling mechanism is combined with the screw rods to quickly adjust the movable plate 2. Refer to the local enlarged view as shown in FIG. 5, the quick pulling mechanism 43 comprises a quick pulling plate 431, a left push rod 432, a right push rod 433, and two fixing bases 434 corresponding to the left push rod and the right push rod.

The front end of the quick pulling plate 431 is inverted trapezoidal shape. The upper side length of the front end of the quick pulling plate 431 is corresponding to the lower side length, whereby the left push rod 432 and the right push rod 433 are capable of being displaced to both sides when the front end of the quick pulling plate 431 moves downwards. The lower end of the quick pulling plate 431 is a handle or a handle ring for easy operation.

The left push rod 432 and the right push rod 433 are respectively connected to the left side and the right side of the quick pulling plate. The quick pulling plate moves downwards to push the left push rod 432 and the right push rod 433 to move toward both sides. To better coordinate with the quick pulling plate 431, the ends of the left push rod 432 and the right push rod 433 in contact with the quick pulling plate 431 are grooves. The groove has an inclined plane inside and matches the two inclined edges of the front end of the quick pulling plate 431.

Figure 6:
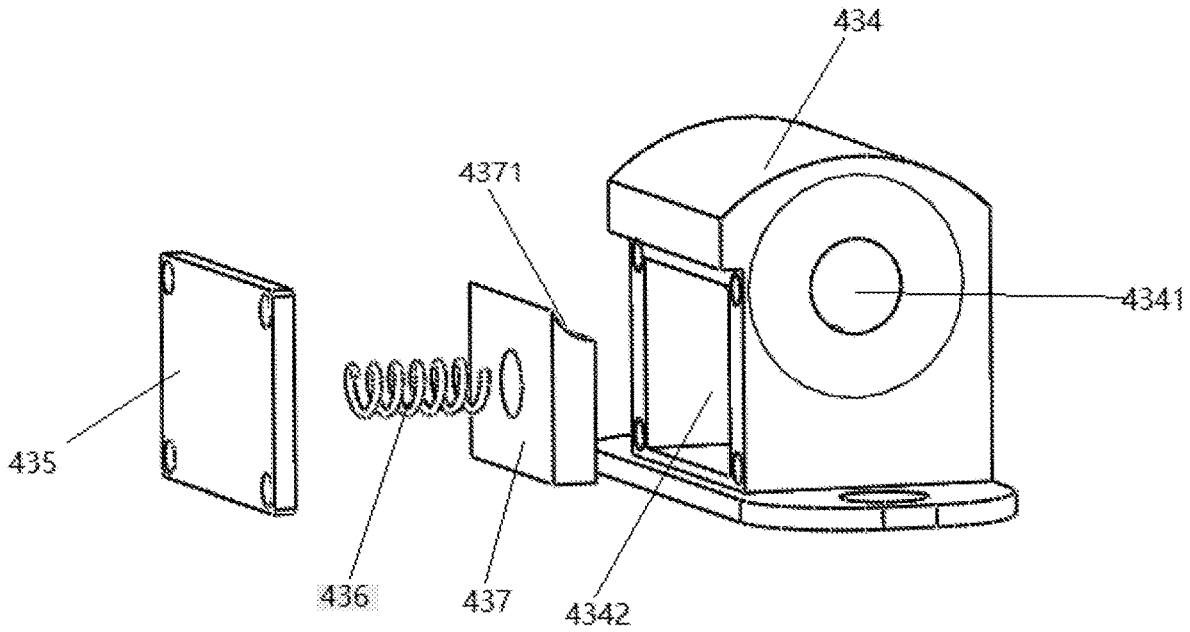
FIG. 6 is a split view of screw rod fixing bases.

The structure of the screw rod fixing bases 434 is as shown in FIG. 6, and the two screw fixing bases 434 are correspondingly fixed on the left fixed rods 122 respectively. The screw rod fixing bases 434 are provided with a radial perforation 4341 and the screw rods 42 pass through therein. The screw rod fixing bases 434 are further provided with a transverse perforation 4342 below the radial perforation 4341, and the radial perforation 4341 and the transverse perforation 4342 are communicated with each other at a connection thereof. One side of the transverse perforation 4342 is locked by a fixed plate 435. A spring 436 and a pressing block 437 with an inner side pressing against the spring 436 are arranged in the transverse perforation 4342, a thread matches the upper side surface 4371 of the pressing block 437 with the screw rods 42, and the outer side surface of the pressing block 437 is abutted against the left push rod 432 or the right push rod 433.

When the quick pulling mechanism 43 is at a locked position, the lower end of the front end of the quick pulling plate 431 is located between the left push rod 432 and the right push rod 433. The left push rod 432 and the right push rod 433 are located at the starting position, and respectively abut the corresponding pressing block 4371. The pressing block 4371 is in contact with the screw rod 42 arranged inside the radial perforation 4341 under the action of the spring 436. The screw rod 42 is locked on the upper surface of the pressing block 4371 through a thread. At this time, the movable plate 2 is only capable of moving the screw rod 42 to rotate and then move relative to the fixed plate 3 by rotating the handle. When the movable plate 2 needs to be moved quickly, the quick pulling plate 431 is pulled downwards, and the quick pulling plate 431 pushes the left push rod 432 and the right push rod 433 toward both sides. At this time, the quick pulling mechanism is at a unlocked position, the left push rod 432 and the right push rod 433 respectively move to both sides to push the corresponding pressing block 4371 to move toward the outer side of the screw rod fixing base 434, the upper surface of the pressing block 4371 is not in contact with the screw rod 42, and the screw rod 42 is capable of being quickly pulled out or retracted to drive the movable plate 2 to move quickly.

As shown in FIG. 2, the right support frame 13 comprises two parallel right support rods 131 and two right fixed rods 132 respectively pivotally connected at tops of the two parallel right support rods 131. The two right fixed rods 132 are respectively capable of being rotatably folded relative to the right support rod 131, and the fixed plate 3 is fixed on the right fixed rod 132.

As shown in FIG. 1 and FIG. 2, a foot 5 is respectively arranged at bottom ends of the two left support rods 121 and the right support rods 131. The foot 5 comprises an elongated edge 51 extending linearly along the outer edge of the left support rod 121 or the right support rod 131, and an inclined straight edge 52 forming an angle with the elongated edge. The elongated edge 51 forms an apex angle 53 with the inclined straight edge 52. When the folding base 1 is fully unfolded, the inclined straight edge 52 flatly contacts the ground. After the folding base is furled, the left support rod 131 and the corresponding right support rod 121 are securely in contact with the ground through the upper apex angle 53, which is more secure than the prior art.

As an extension of the present application, in this embodiment, at least one storage rack 6 is arranged on the left support frame 12 and/or right support frame 13. The storage rack 6 is provided with a plurality of storage holes 61 with various hole patterns. The storage holes are used to fix some common processing tools such as vice, drilling tools and saws.

As another extension of the present application, in this embodiment, the left support frame 12 and/or the right support frame 13 are provided with at least one table fixture stand 7, and table fixtures 71 arranged in the first fixing hole 21 and the second fixing hole 22 are fixed on the table fixture stand. A fixed column is arranged at the bottom of table fixture 71 and can be embedded into the first fixing hole 21 and arranged in the second fixing hole 22. A fixing groove or convex bar is provided on one side or both sides of the table fixture 71 to fix processing items.

To further ensure stability of the workbench during processing of workpieces, a foot lever 8 is provided at the bottom end of the left support frame 12 and/or the right support frame 13. The foot lever 8 can be stepped on during the processing to stabilize the workbench.

As shown in FIG. 1, the fixed plate 3 comprises a first fixed plate 32 and a second fixed plate 33. The first fixed plate 32 is integrally connected with the movable plate 2 and provided with a ruler and/or a third fixing hole 321. The ruler provided on the first fixed plate 32 facilitates measurement or positioning during processing, which is convenient to use. The table fixtures 7 can also be embedded in the third fixing hole 321 for use.

As shown in FIG. 2, the lower surface of the first fixed plate 32 is provided with a lock hook 32, and the lower surface of the second fixed plate 33 is provided with a fixed column 35. The first fixed plate 32 and the second fixed plate 33 are locked by toggling the lock hook 34 to hook the fixed column 35. Of course, a fixed column can be arranged on the lower surface of the first fixed plate, and a lock hook can be disposed on the lower surface of the second fixed plate. Various similar modifications can be achieved without limitation to the change of the hook and the fixed column or other forms on condition that the first fixed plate and the second fixed plate can be fixed.

Figure 7:
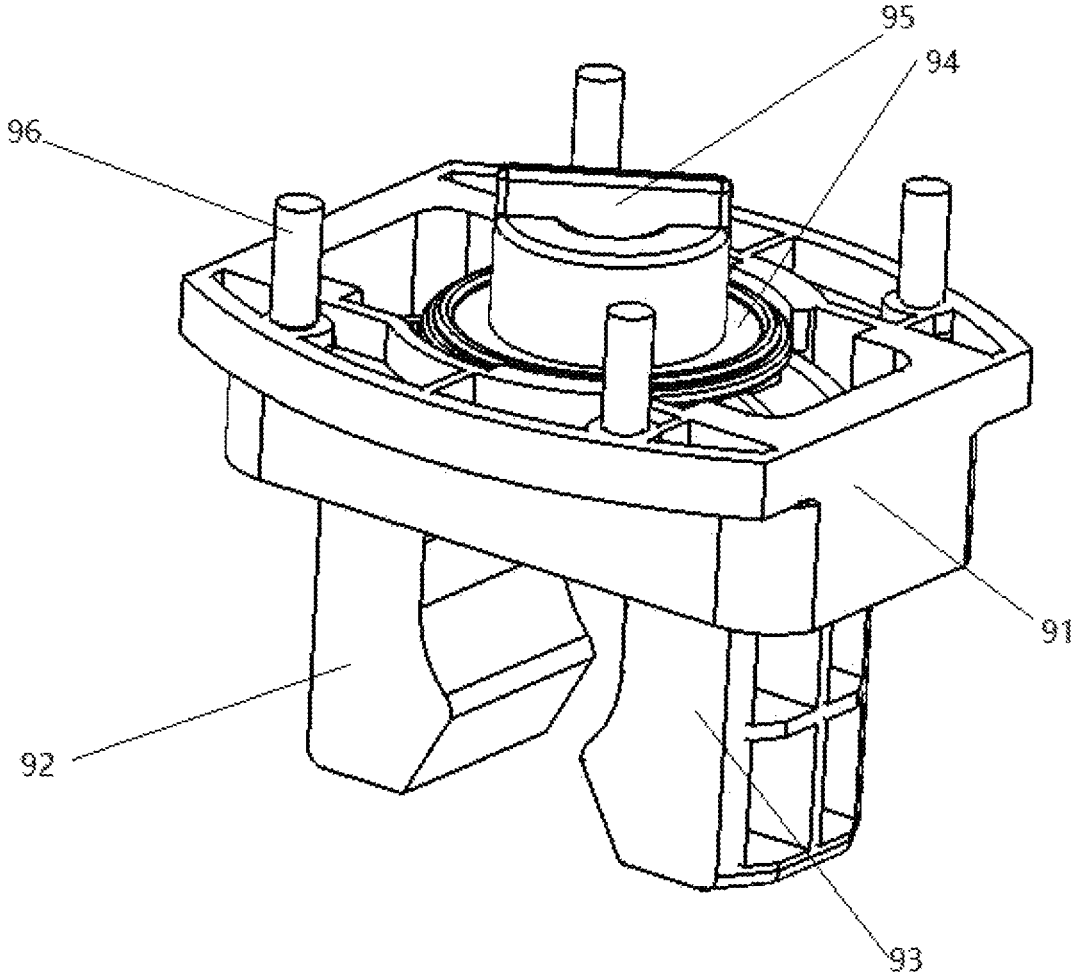
FIG. 7 is a structural diagram of the locking mechanism.
Figure 8:
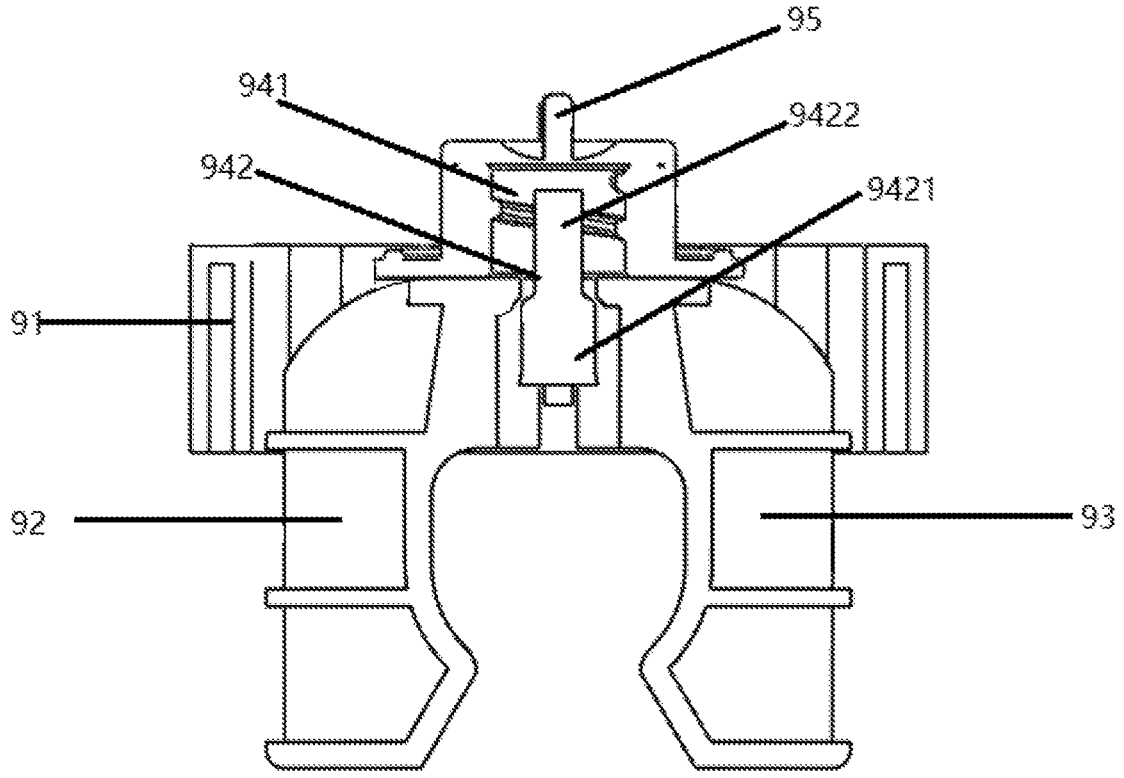
FIG. 8 is a sectional view of the locking mechanism.

In addition, as shown in FIG. 2, FIG. 7 and FIG. 8, the fixed plate 2 (the second fixed plate 33 in this embodiment) is provided with a locking mechanism 9 which comprises a fixing base 91, a left clamping rod 92, a right clamping rod 93, an adjusting rod 94 and an adjusting knob 95. The locking mechanism is used to ensure that the second fixed plate 33 can be firmly fixed on the handle rod, further enhancing the stability. The fixing base 91 is provided with a perforation and fixed on the lower surface of the second fixed plate 33 by bolts 96. The left clamping rod 92 and the right clamping rod 93 are oppositely disposed in the perforation. A gripping space is formed between the left clamping rod 92 and the right clamping rod 93 for gripping the handle rod 14. The adjusting rod 94 comprises a fixed end 941 with an outward turning thread and a lifting rod 942 connected to the fixed end 941. Diameter of the lower end 9421 of the pulling rod is larger than that of the upper end 9422 of the lifting rod, which embosses the lower end 9421 of the pulling rod The lifting rod 942 is clamped between the left clamping rod 92 and the right clamping rod 93. When the adjusting rod 94 is rotated to a unlocked position, the upper end 9422 of the lifting rod is located between the left clamping rod 92 and the right clamping rod 93, the lower ends 9421 of the lifting rod is located at the lower ends of the left clamping rod 92 and the right clamping rod 93, and the left clamping rod 92 and the right clamping rod 93 are capable of rotating relative to each other. When the adjusting rod 94 is rotated to a locked position, the lower end 9421 of the lifting rod is located between the left clamping rod 92 and the right clamping rod 93, and the lower end 9421 of the lifting rod fixes top ends of the left clamping rod 92 and the right clamping rod 93, the space between the left clamping rod 92 and the right clamping rod 93 is fixed. The adjusting knob 95 is arranged at the adjusting rod 94 and is located on the upper surface of the second fixed plate 33. The adjusting knob 95 drives the fixed end 941 of the adjusting rod 94 to rotate to adjust the space between the left clamping rod 92 and the right clamping rod 93.

It should be understood that these embodiments are used to describe but not limit the scope of the present invention. What's more, it should be understood that various changes and modifications can be made by those skilled in the art after the content of this invention taught being read. And such equivalent forms will fall into the protection scope as defined in the claims.

The invention claimed is:

1. A workbench, comprising:

a folding base comprising a left support frame and a right support frame cross connected with each other by a pivot and a handle rod connected with tops of the left support frame and the right support frame;

a movable plate fixed on the left support frame and provided with at least one first fixing hole;

a fixed plate fixed on the right support frame and provided with at least one second fixing hole; and the movable plate and the fixed plate are spread out on the upper surface of the folding base as the left support frame and the right support frame are unfolded; and the movable plate and the fixed plate are folded downwards along both sides of the handle rod as the left support frame and the right support frame are furled;

wherein the left support frame comprises two parallel left support rods and two left fixed rods pivotally connected with tops of the two parallel left support rods respectively; the two left fixed rods are respectively capable of being rotatably folded relative to the left support rod, front ends of the two left fixed rods are respectively provided with a pitch adjusting mechanism, and the movable plate is fixed on the two pitch adjusting mechanisms and moves away from the fixed plate according to adjustment of the pitch adjusting mechanisms; and the right support frame comprises two parallel right support rods and two right fixed rods respectively pivotally connected with tops of the two parallel right support rods; the two right fixed rods are respectively capable of being rotatably folded relative to the right support rods, and the fixed plate is fixed on the right fixed rods.

2. The workbench of claim 1, wherein the pitch adjusting mechanism comprises screw rods connected with a handle and a quick pulling mechanism capable of controlling quick pushing and pulling of the screw rods, and the quick pulling mechanism comprises:

a left push rod and a right push rod respectively connected to the left side and the right side of the quick pulling plate, wherein the quick pulling plate moves downwards to push the left push rod and the right push rod to move toward both sides;

two screw rod fixing bases respectively fixed on one of the left fixed rods, wherein the screw rod fixing bases are provided with a radial perforation and the screw rods pass through therein; the screw rod fixing bases are further provided with a transverse perforation below the radial perforation, and the radial perforation and the transverse perforation are communicated with each other at a connection thereof; one side of the transverse perforation is locked by a fixed plate; a spring and a pressing block with an inner side face pressing against the spring are arranged in the transverse perforation, a thread matches the upper side face of the pressing block with the screw rods; and the outer side surface of the pressing block is abutted against the left push rod or the right push rod;

when the quick pulling mechanism is at a locked position, the left push rod and the right push rod respectively abut the pressing block, and the pressing block is in contact with the screw rods arranged inside the radial perforation under the action of the spring, and the movable plate is only capable of moving relative to the fixed plate through manual rotation of the screw rods; and when the quick pulling plate is pulled down such that the quick pulling mechanism is at a unlocked position, the left push rod and the right push rod respectively move to both sides and push the pressing block to move toward outsides of the screw rod fixing bases, the upper surface of the pressing block does not contact the screw rods, and the screw rods are capable of being quickly pulled out or retracted.

3. The workbench of claim 1, wherein a foot is respectively arranged at bottom ends of the two left support rods and the right support rods, the foot comprises an elongated edge extending linearly along the outer edge of the left support rod or the right support rod, and an inclined straight edge forming an angle with the elongated edge; the elongated edge forms an apex angle with the inclined straight edge, and when the folding base is fully unfolded, the inclined straight edge flatly contacts the ground; and after the folding base is furled, the left support rod and the corresponding right support rod are securely in contact with the ground through the upper apex angle.

4. The workbench of claim 1, wherein the left support frame and/or the right support frame are provided with at least one storage rack, and the rack is provided with a plurality of storage holes with various hole patterns.

5. The workbench of claim 4, wherein a foot lever is provided at the bottom end of the left support frame and/or the right support frame.

6. The workbench of claim 5, wherein the left support frame and/or the right support frame are provided with at least one table fixture stand, and table fixtures arranged in the first fixing hole and the second fixing hole are fixed on the table fixture stand.

7. The workbench of claim 1, wherein the fixed plate comprises a first fixed plate and a second fixed plate, and the first fixed plate is integrally connected with the movable plate and provided with a ruler and/or a third fixing hole.

8. The workbench of claim 7, wherein the lower surface of the first fixed plate is provided with a lock hook or fixed column, and the lower surface of the second fixed plate is correspondingly provided with a fixed column or lock hook, and the first fixed plate and the second fixed plate are locked by toggling the lock hook to hook the fixed column.

9. The workbench of claim 1, wherein the fixed plate is provided with a locking mechanism for fixing the second fixed plate and the handle rod, and the locking mechanism comprises:

a fixing base which is provided with a perforation and fixed on the lower surface of the second fixed plate by bolts;

a left clamping rod and a right clamping rod which are oppositely arranged at in the perforation and between which a gripping space for gripping the handle rod is formed;

an adjusting rod comprising a fixed end with an outward turning thread and a lifting rod connected to the fixed end, wherein diameter of the lower end of the pulling rod is larger than that of the upper end of the lifting rod, the lifting rod is arranged between the left clamping rod and the right clamping rod, when the adjusting rod is rotated to a unlocked position, the upper end of the lifting rod is located between the left clamping rod and the right clamping rod, and the left clamping rod and the right clamping rod are capable of rotating relative to each other; when the adjusting rod is rotated to a locked position, the lower end of the lifting rod is located between the left clamping rod and the right clamping rod, and the lower end of the lifting rod fixes the top ends of the left clamping rod and the right clamping rod, and the space between the left clamping rod and the right clamping rod is fixed; and an adjusting knob arranged at the adjusting rod and located on the upper surface of the second fixed plate; wherein the adjusting knob drives the fixed end of the adjusting rod to rotate to adjust the space between the left clamping rod and the right clamping rod.

* * * * *